United States Patent [19]

Ledbetter

[11] Patent Number: 5,048,892

[45] Date of Patent: Sep. 17, 1991

[54] LAWN CHAIR PAD HAVING FLUID, PNEUMATIC AND POLYMERIC CHAMBERS

[76] Inventor: Mart O. Ledbetter, 5760 Shady Oak St., Huber Heights, Ohio 45424

[21] Appl. No.: 578,676

[22] Filed: Sep. 7, 1990

[51] Int. Cl.[5] ..... A47C 27/00; A47C 31/00

[52] U.S. Cl. ..... 297/219; 297/414; 297/397; 297/DIG. 3; 5/441

[58] Field of Search ..... 297/145, 148, 153, 194, 297/218, 219, 227, 228, 411, 412, 413, 414, 415, 416, 419, 420, 421, 422, 423, 427, 428, 429, DIG. 1, DIG. 2, DIG. 8, 199, 200, 201, DIG. 3, 397; 267/117; 5/441, 443, 448, 449, 450, 455, 456

[56] References Cited

U.S. PATENT DOCUMENTS

| | | | |
|---|---|---|---|
| 1,247,547 | 11/1917 | Eune | 297/414 |
| 1,640,618 | 8/1927 | Sampson | 267/117 |
| 1,650,385 | 11/1927 | Payton | 297/413 |
| 2,679,893 | 6/1954 | Bennett | 297/423 |
| 2,822,554 | 2/1958 | Wenzelberger | 5/441 |
| 3,428,357 | 2/1969 | Lueck | 297/194 X |
| 3,512,829 | 5/1970 | Paris | 297/148 |
| 4,247,963 | 2/1981 | Reddi | 5/441 X |
| 4,285,544 | 8/1981 | Zapf | 297/218 X |
| 4,383,712 | 5/1983 | Kaganas | 297/219 |
| 4,470,630 | 9/1984 | Shields | 297/118 |
| 4,565,405 | 1/1986 | Mayer | 297/219 X |
| 4,676,376 | 6/1987 | Keiswetter | 297/219 X |
| 4,712,833 | 12/1987 | Swanson | 297/219 |
| 4,761,011 | 8/1988 | Sereboff | 297/DIG. 3 X |

FOREIGN PATENT DOCUMENTS

| | | | |
|---|---|---|---|
| 717885 | 11/1954 | United Kingdom | 297/412 |

*Primary Examiner*—Kenneth J. Dorner
*Assistant Examiner*—James M. Gardner
*Attorney, Agent, or Firm*—Leon Gilden

[57] ABSTRACT

An elongate longitudinally aligned cushion member mounted about a selective frame portion of an associated lawn chair to effect desired cushioning relative to the lawn chair structure. The organization is defined by a tubular member, including a coaxially aligned board directed therethrough. A modification of the invention includes an elongate member defined by a serpentine exterior configuration defining parallel ribs, with the member including a pneumatic chamber therewithin and further including an overlying fluid chamber and an underlying chamber formed of a resilient pad-like member.

1 Claim, 4 Drawing Sheets

LAWN CHAIR PAD HAVING FLUID, PNEUMATIC AND POLYMERIC CHAMBERS

BACKGROUND OF THE INVENTION

1. Field of the Invention

The field of invention relates to lawn chair apparatus, and more particularly pertains to a new and improved lawn chair paid construction wherein the same includes a pad-like member mounted in a selective manner about a desired framework portion of an associated lawn chair structure.

2. Description of the Prior Art

Padding for mounting relative to frameworks of chairs, lounge chairs, and the like is provided in the prior art. Heretofore, however, such pad-like structures have been confined to discrete portions of an associated chair construction, as opposed to the instant invention which may be surmounted about various portions of an associated lawn chair as desired. Examples of the prior art include U.S. Pat. No. 4,285,544 to Zapf wherein a chair includes a plate-like member defining arm rests, with a cushion-like sleeve mounted overlying the arm rest as required.

U.S. Pat. No. 4,383,712 to Kaganas sets forth a seat cover for overlying an automotive seat, including a pad-like composition defining the seat construction.

U.S. Pat. No. 4,565,405 to Mayer provides a seat and backrest utilizing resilient material interposed between a surrounding cover.

U.S. Pat. No. 4,676,376 to Keiswetter provides a seat cover defined by a polyethylene film.

U.S. Pat. No. 4,712,833 to Swanson sets forth a seat cushion defined by a padded material of a wide shaped configuration to overlie a seat portion of an infant or weakened adult.

As such, it may be appreciated that there continues to be a need for a new and improved lawn chair pad construction wherein the same addresses both the problems of ease of use as well as effectiveness in construction and in this respect, the present invention substantially fulfills this need.

SUMMARY OF THE INVENTION

In view of the foregoing disadvantages inherent in the known types of chair pad constructions now present in the prior art, the present invention provides a lawn chair pad construction wherein the same is provided for selective securement about a desired framework portion of an associated lawn chair. As such, the general purpose of the present invention, which will be described subsequently in greater detail, is to provide a new and improved lawn chair pad construction which has all the advantages of the prior art chair pad constructions and none of the disadvantages.

To attain this, the present invention provides an elongate longitudinally aligned cushion member mounted about a selective frame portion of an associated lawn chair to effect desired cushioning relative to the lawn chair structure. The organization is defined by a tubular member, including a coaxially aligned board directed therethrough. A modification of the invention includes an elongate member defined by a serpentine exterior configuration defining parallel ribs, with the member including a pneumatic chamber therewithin and further including an overlying fluid chamber and an underlying chamber formed of a resilient pad-like member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved lawn chair pad construction which has all the advantages of the prior art chair pad constructions and none of the disadvantages.

It is another object of the present invention to provide a new and improved lawn chair pad construction which may be easily and efficiently manufactured and marketed.

It is a further object of the present invention to provide a new and improved lawn chair pad construction which is of a durable and reliable construction.

An even further object of the present invention is to provide a new and improved lawn chair pad construction which is susceptible of a low cost of manufacture with regard to both materials and labor, and which accordingly is then susceptible of low prices of sale to the consuming public, thereby making such lawn chair pad constructions economically available to the buying public.

Still yet another object of the present invention is to provide a new and improved lawn chair pad construction which provides in the apparatuses and methods of the prior art some of the advantages thereof, while simultaneously overcoming some of the disadvantages normally associated therewith.

Still another object of the present invention is to provide a new and improved lawn chair pad construction wherein the same permits ease of assembly relative to an associated lawn chair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
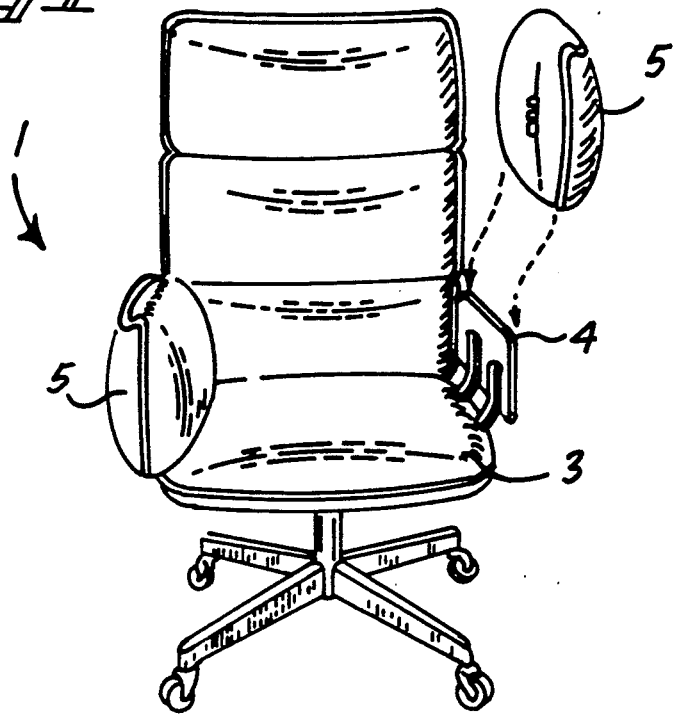
FIG. 1 is an isometric illustration of a prior art chair and pad construction.
Figure 2:
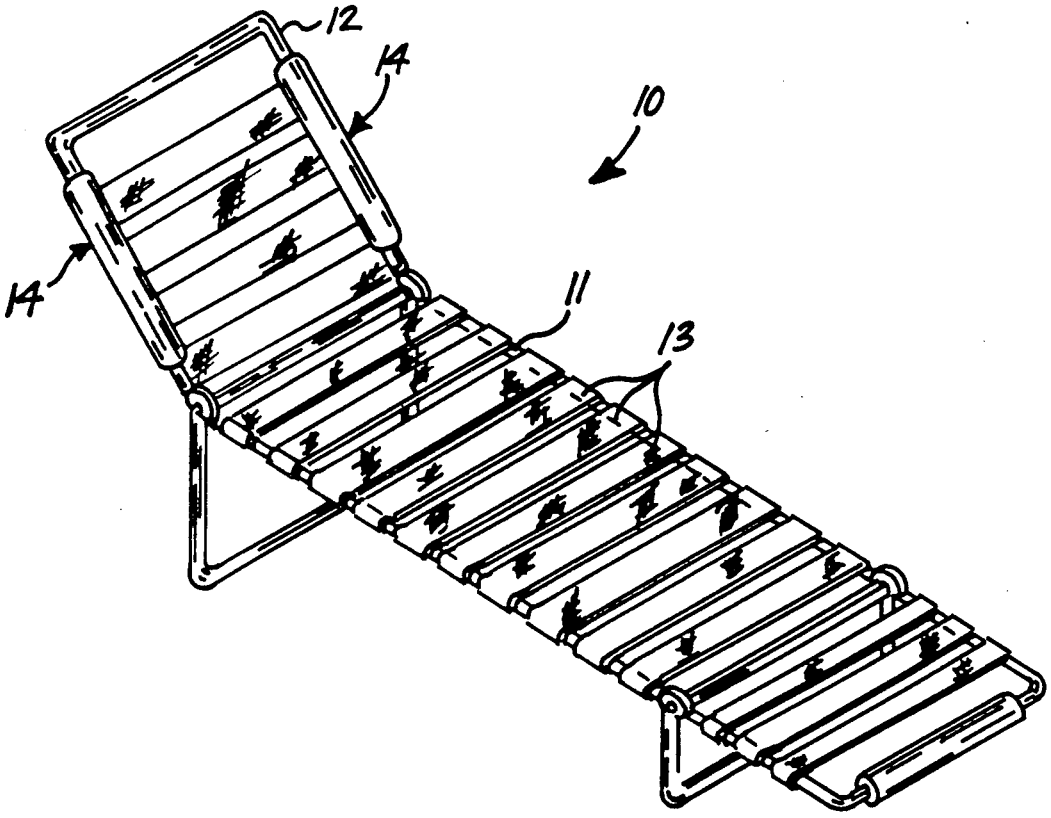
PRIOR ART FIG 2
FIG. 2 is an isometric illustration of the instant invention.

With reference now to the drawings, and in particular to FIGS. 1 to 8 thereof, a new and improved lawn chair pad construction embodying the principles and concepts of the present invention and generally designated by the reference numeral 10 will be described.

FIG. 1 illustrates a prior art chair member 1 defined by a seat portion 3 and arm rest portions 4, wherein pads 5 are selectively surmounted about the arm rest plate members 4.

Figure 3:
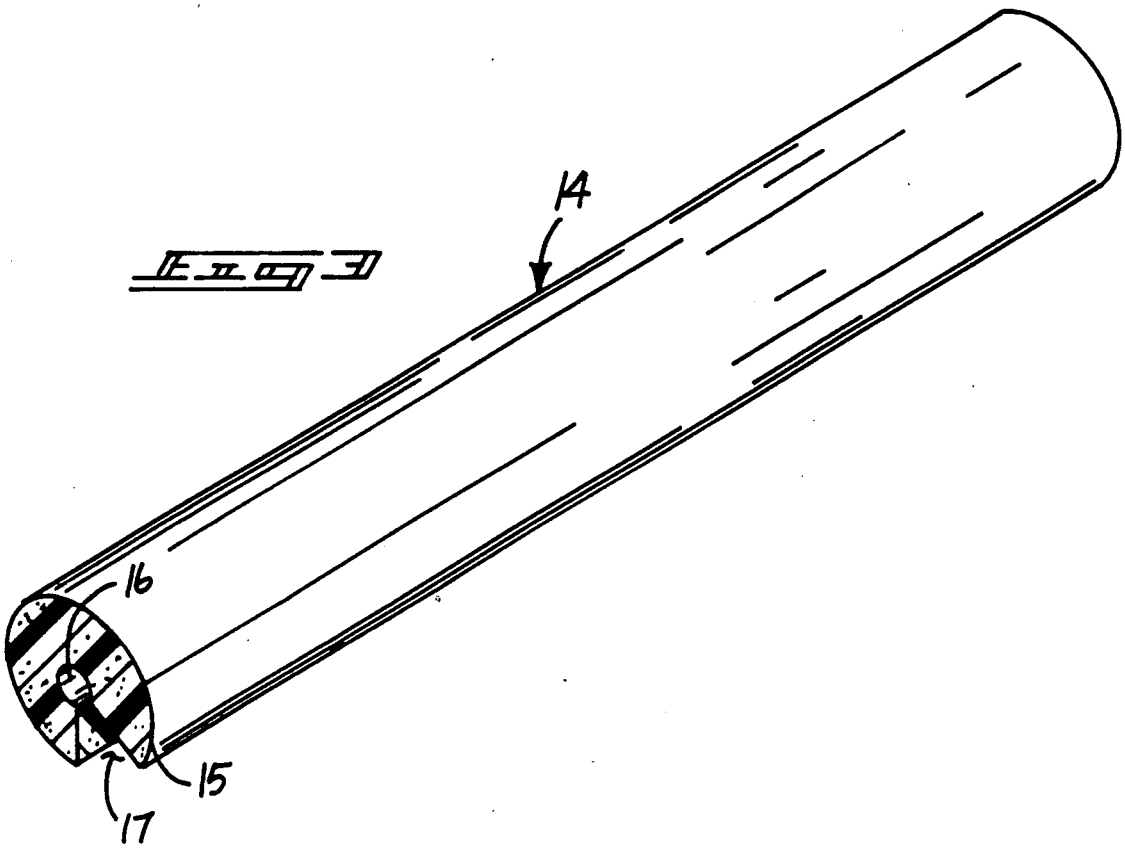
FIG. 3 is an isometric illustration of the pad member utilized by the instant invention.
Figure 4:
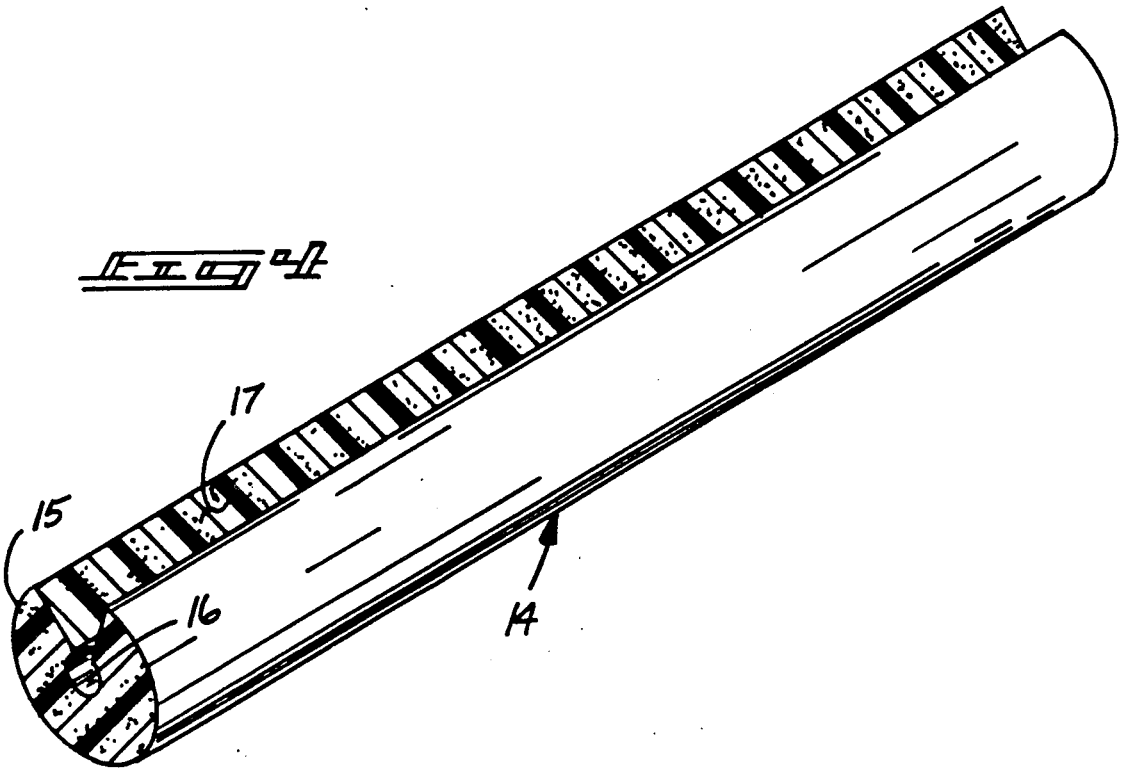
FIG. 4 is an isometric illustration of the pad construction in an inverted orientation relative to FIG. 3.

More specifically, the lawn chair pad construction 10 of the instant invention essentially comprises a lawn chair including a seat tubular framework 11 and a backrest tubular framework 12 pivotally mounted to the seat tubular framework. The seat and backrest tubular frameworks define a perimeter framework about the organization defining the lawn chair, with flexible support slats 13 arranged parallel relative to one another spanning parallel elongate bars of the seat and backrest frameworks 11 and 12. To this end, coaxially aligned tubular cushion members 14 are selectively securable about desired portions of the seat or backrest tubular frameworks 11 or 12, as required by a user thereof for comfort of an arm, head portion, legs, and the like as desired. With reference to FIGS. 3 and 4, the tubular cushion member 14 is defined by a construction utilizing a polymeric memory retentent material that is resilient and deformable, yet returning to original configuration, as illustrated, with the elongate through-extending coaxially aligned bore 16 directed through the cushion member 14, with an elongate body slot 17 directed through the side wall to permit securement of a framework member into the bore 16.

Figure 5:
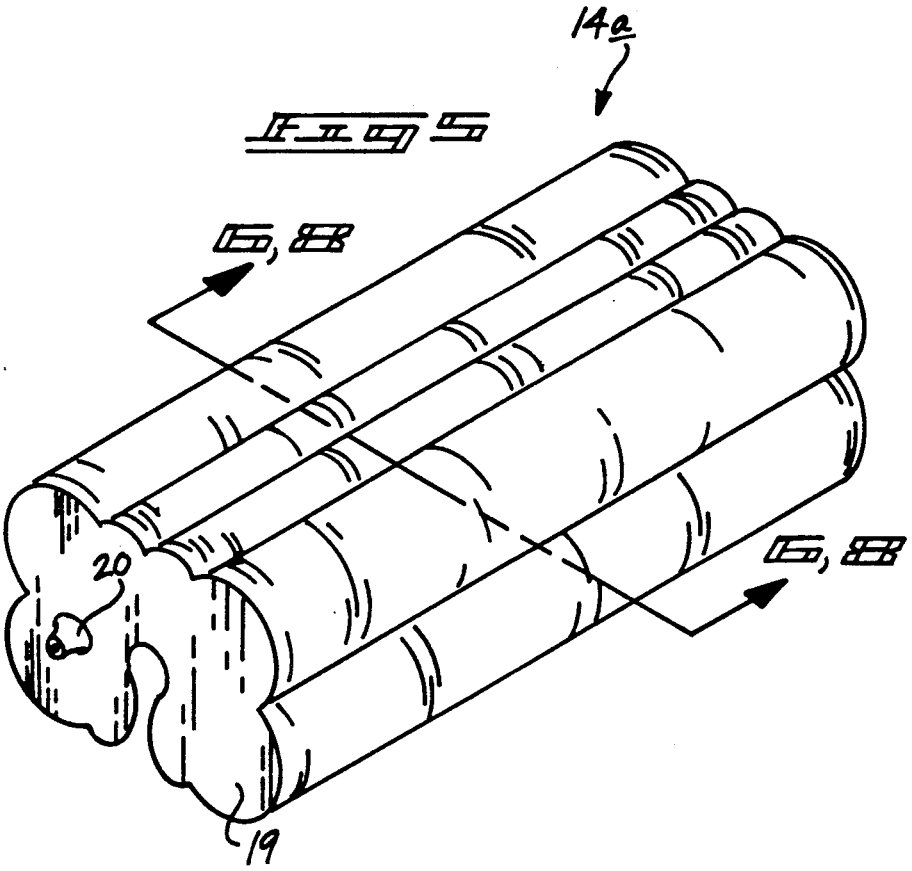
FIG. 5 is an isometric illustration of a modification of the pad member of the instant invention.
Figure 6:
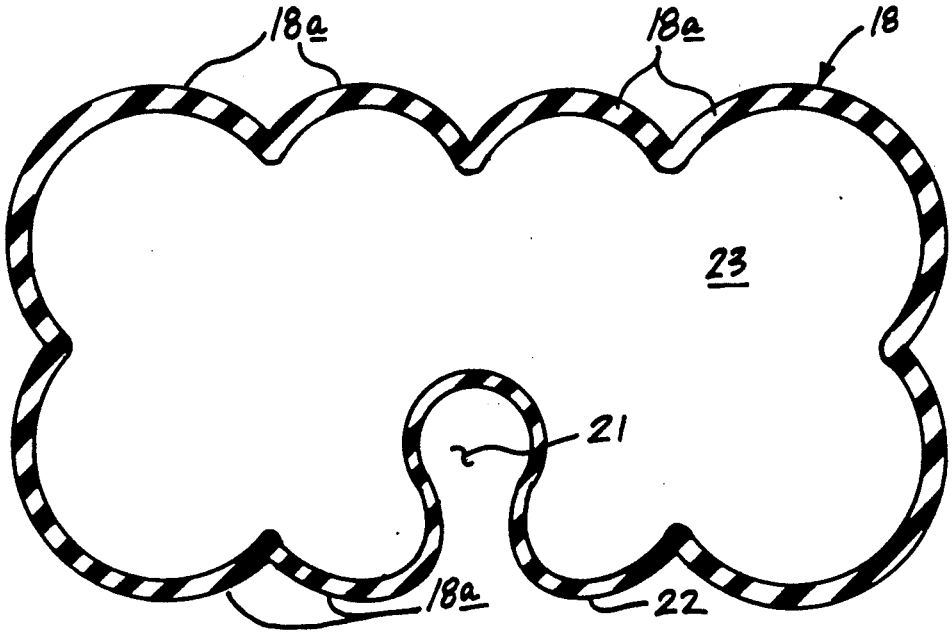
FIG. 6 is an orthographic view, taken along the line 6—6 of FIG. 5, in the direction indicated by the arrows.
Figure 7:
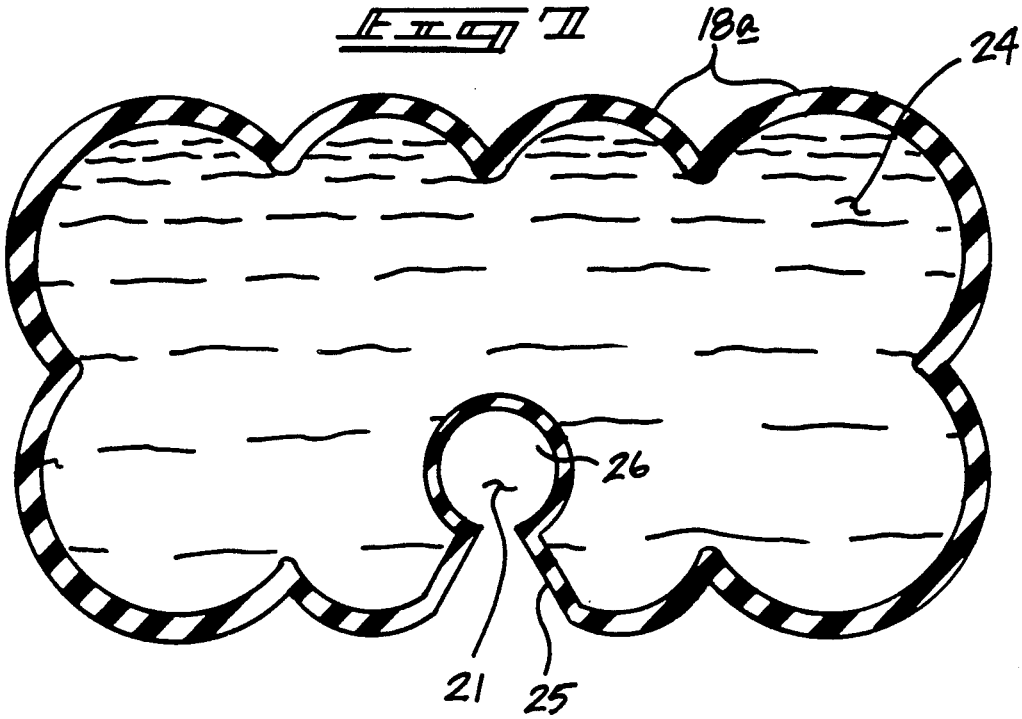
FIG. 7 is an orthographic view of the pad member of FIG. 5 defining a fluid-filled chamber.

Reference to FIG. 5 illustrates a modification of the cushion member 14, wherein the longitudinally aligned cushion member **14*a* is defined by a forward wall 19 and a like parallel rear wall of like configuration, but with the forward wall 19 including an air valve 20 positioned medially of the height of the forward wall 19. The modified cushion member 14 is defined by a serpentine exterior side wall 18 to define spaced parallel cushion ribs 18*a* for comfort in accommodating in a convenient manner deflection thereof by an individual interposing a leg, arm, and the like thereon. The body member includes a through-extending keyhole-like cavity 21 directed radially and interiorly into the modified cushion member 14*a* from a bottom wall surface 22 thereof. The cushion members 18*a* extend about the complete perimeter of the side wall 18 to define the keyhole cavity 22 that includes a cylindrical central longitudinally aligned opening 26, with a wedge-shaped elongate entrance cavity 25 to direct a framework member of the seat and backrest tubular framework 11 or 12 within the cushion member. The cushion member 14*a* is defined by a pneumatic chamber 23 that may be selectively filled through the air valve 20. FIG. 7 illustrates the use of the cavity 23 filled with a fluid 24** for providing a weighted cushion member minimizing deflection when positioned upon the lawn chair.

Figure 8:
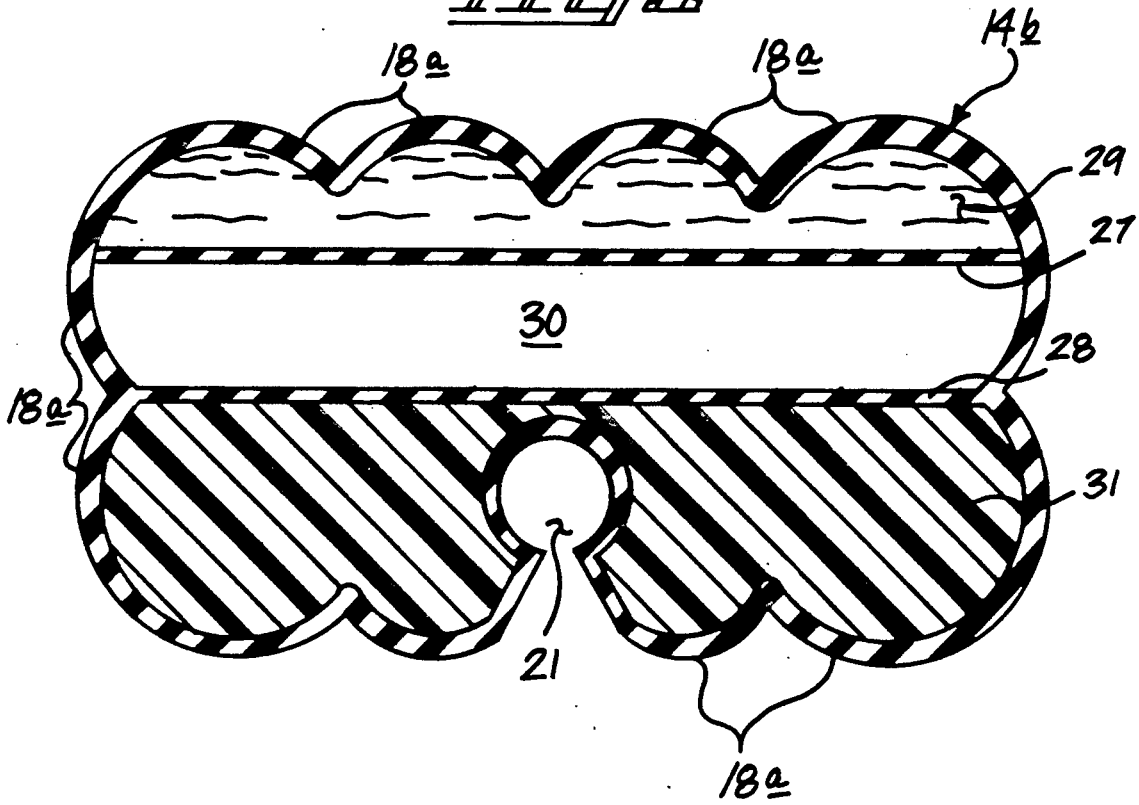
FIG. 8 is an orthographic cross-sectional illustration of FIG. 5 utilizing a multi-chamber construction.

FIG. 8 illustrates a further modified cushion member **14*b*, wherein a first planar partition wall 27 is formed within the member 14*b* and longitudinally aligned relative to the cushion member 14*a*, with a second planar partition wall 28 spaced parallel from and below the first planar partition wall. Each partition wall is formed of a flexible material to define a respective first upper chamber 29 that includes a sealed fluid chamber for comfort and convenience during use. A second chamber 30 is positioned medially of the cushion member 14*b* and cooperative with the air valve 20 for selective filling of the second chamber to define various levels of height and resistance of the cushion member 14*b* in use. The bottom and third chamber 31 is completely filled with a deformable memory retentent polymeric material of a type as utilized and defined by material 15, with reference to FIGS. 3 and 4**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lawn chair pad construction, comprising in combination, a chair defined by a seat tubular framework and a backrest tubular framework, and an elongate longitudinally aligned cushion member selectively securable to selective portions of the seat tubular framework or the backrest tubular framework, wherein the cushion member includes a longitudinally aligned elongate through-extending bore directed through the cushion member, and the bore including an elongate wedge-shaped slot diametrically aligned with the bore to permit selective securement of the cushion member to the seat tubular framework or the backrest tubular framework, and wherein the cushion member includes a forward wall spaced from a rear wall, and a serpentine exterior side wall extending coextensively between the forward wall and rear wall to define an enclosed chamber, the serpentine side wall defining parallel cushion ribs to effect comfort of an individual positioning a body part thereon in deflection of the side wall, and wherein the forward wall includes an air valve positioned medially of a predetermined height defined by the forward wall to permit selective inflation within the cushion member, and wherein the enclosed chamber includes a first planar partition wall extending longitudinally and coextensively and interiorly of the enclosed chamber and longitudinally aligned relative to the cushion member, and a second planar partition wall spaced from and parallel the first planar partition wall and longitudinally aligned within the enclosed chamber of the cushion member, and wherein a first chamber is defined between the first planar partition wall and the side wall, wherein the first chamber includes a predetermined quantity of fluid sealingly contained within the first chamber, and wherein a second chamber defined between the first planar partition wall and the second planar partition wall is in pneumatic communication with the air valve to permit selective inflation of the second chamber, and wherein a third chamber is defined between the second partition wall and the side wall, wherein the third chamber is completely filled with a deformable memory retentent polymeric member, wherein the polymeric member is surroundingly positioned about the elongate body slot.

* * * * *